US007241157B2

(12) United States Patent
Zhuang et al.

(10) Patent No.: US 7,241,157 B2
(45) Date of Patent: Jul. 10, 2007

(54) MODULAR JACK WITH A DETECTIVE SWITCH

(75) Inventors: Quan Zhuang, Kunsan (CN); Zhi-qiang Chen, Kunsan (CN); Hao-Dong Zhao, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/102,150

(22) Filed: Apr. 7, 2005

(65) Prior Publication Data

US 2005/0227524 A1 Oct. 13, 2005

(30) Foreign Application Priority Data

Apr. 9, 2004 (CN) ..... 2004 2 0262063 U

(51) Int. Cl.
*H01R 29/00* (2006.01)

(52) U.S. Cl. ..... 439/188; 439/488; 439/607; 439/676

(58) Field of Classification Search ..... 439/188, 439/944, 607–610, 101, 488–489, 108, 668, 439/676, 63
See application file for complete search history.

(56) References Cited

U.S. PATENT DOCUMENTS

| | | | | |
|---|---|---|---|---|
| 5,704,797 | A * | 1/1998 | Meyerhoefer et al. | 439/188 |
| 5,772,466 | A | 6/1998 | Morin et al. | |
| 6,231,362 | B1 * | 5/2001 | Wu | 439/188 |
| 6,296,492 | B1 * | 10/2001 | Fujimoto et al. | 439/63 |
| 6,322,397 | B1 * | 11/2001 | Zhang | 439/668 |
| 6,394,853 | B1 * | 5/2002 | Hammond et al. | 439/676 |

* cited by examiner

*Primary Examiner*—Truc T. Nguyen
*Assistant Examiner*—Edwin A. Leon
(74) *Attorney, Agent, or Firm*—Wei Te Chung

(57) ABSTRACT

A modular jack (100) includes an insulative housing (1) defining a receiving cavity (151) for receiving a complementary connector, a contact module (2), a detective switch (3) and an outer metal shield (4) enclosing the housing. The detective switch includes an immovable switch (31) and a movable switch (32) abutting against the immovable switch. The immovable and movable switches respectively include an engaging portion (311, 3212) and a soldering portion (313, 323) for electrically connecting with a printed circuit board. The movable switch further includes a projecting portion (3211) for engaging with the complementary connector.

4 Claims, 13 Drawing Sheets

MODULAR JACK WITH A DETECTIVE SWITCH

BACKGROUND OF THE INVENTION

1. Field of the Invention

This invention generally relates to a modular jack and more particularly, to a modular jack with a detective switch.

2. Description of the Prior Art

In telecommunication field, there are known two particularly widely used styles of modular plug connectors, RJ11 and RJ45. When a mating connector is inserted into a receiving cavity of the RJ11 or RJ45, we cannot judge whether the mating connector is completely inserted into the cavity or not. As a result, a detective switch is needed in the RJ11 or RJ45. U.S. Pat. No. 5,772,466 discloses a conventional modular jack having an insulative housing defining a receiving cavity, an array of conductive contacts and an outer metal shield enclosing the housing. The outer metal shield defines a pair of fingers backwardly extending into the receiving cavity from a front face thereof. The modular jack further includes a pair of detective switches fixed the sidewall of the housing for engaging with the fingers. In use, the mating connector is inserted into the receiving cavity and presses the fingers to electrically connect the detective switches, thereby realizing the detective function. However, the fingers connect with the outer metal shield. In use, the current of a printed circuit board is easily transmitted to the outer metal shield, thereby reducing the efficiency of preventing electromagnetic interference and impairing the signal transmission between the modular jack and the mating connector.

Hence, an improved modular jack is desired to overcome the above problems.

BRIEF SUMMARY OF THE INVENTION

It is an object of the present invention to provide a modular jack which has a good detective function.

In order to attain the object above, a modular jack according to the present invention includes an insulative housing, a plurality of conductive contacts and a detective switch disposed in the housing and an outer shield enclosing the housing. The housing defines a receiving cavity for receiving a complementary connector. The detective switch includes an immovable switch and a movable switch for engaging with the immovable switch. The immovable switch and the movable switch respectively includes an engaging portion for electrically connecting each other and a soldering portion for electrically connecting with a printed circuit board. The movable switch further includes a projecting portion through a cutout in a sidewall of the insulative housing to be received in the cavity for engaging with the complementary connector. Comparing to prior art, the detective switch disconnects with the outer metal shield to realize the detective function.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Reference will now be made in detail to the preferred embodiment of the present invention.

Figure 1:
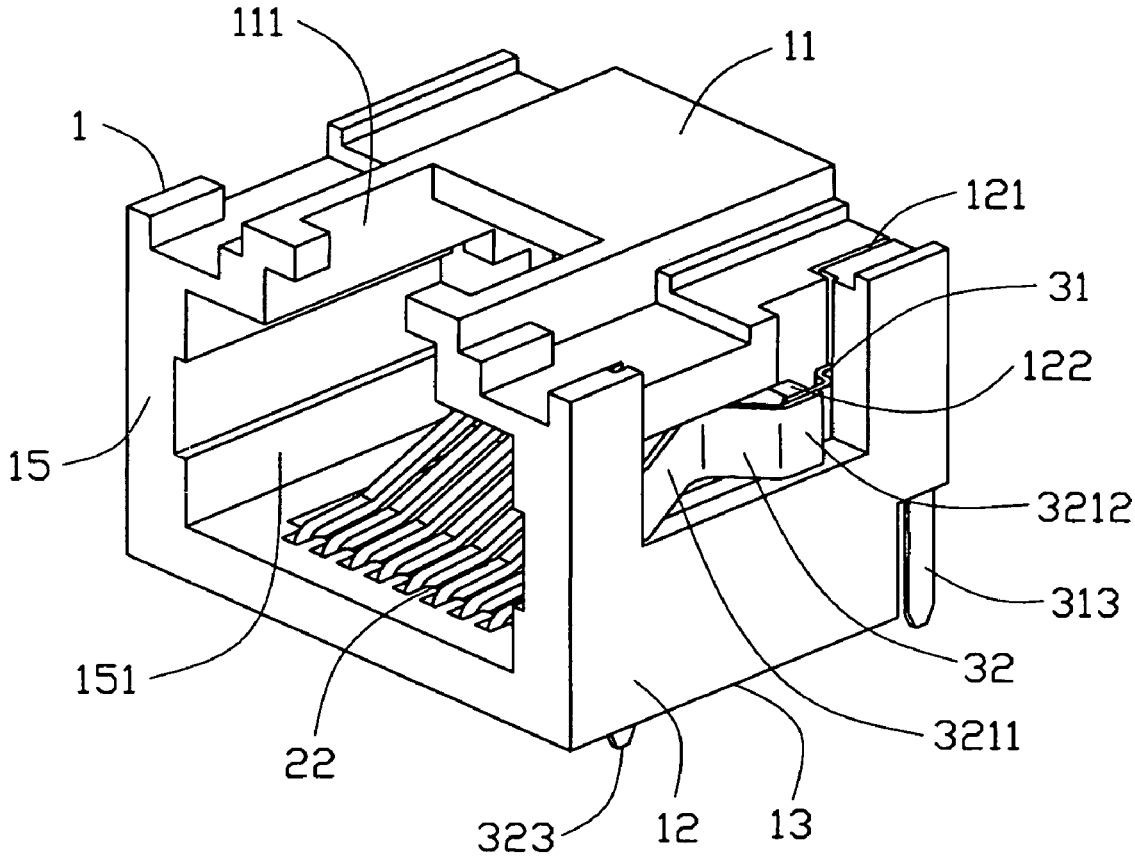
FIG. 1 is a partially assembled view of a modular jack according to the present invention.
Figure 2:
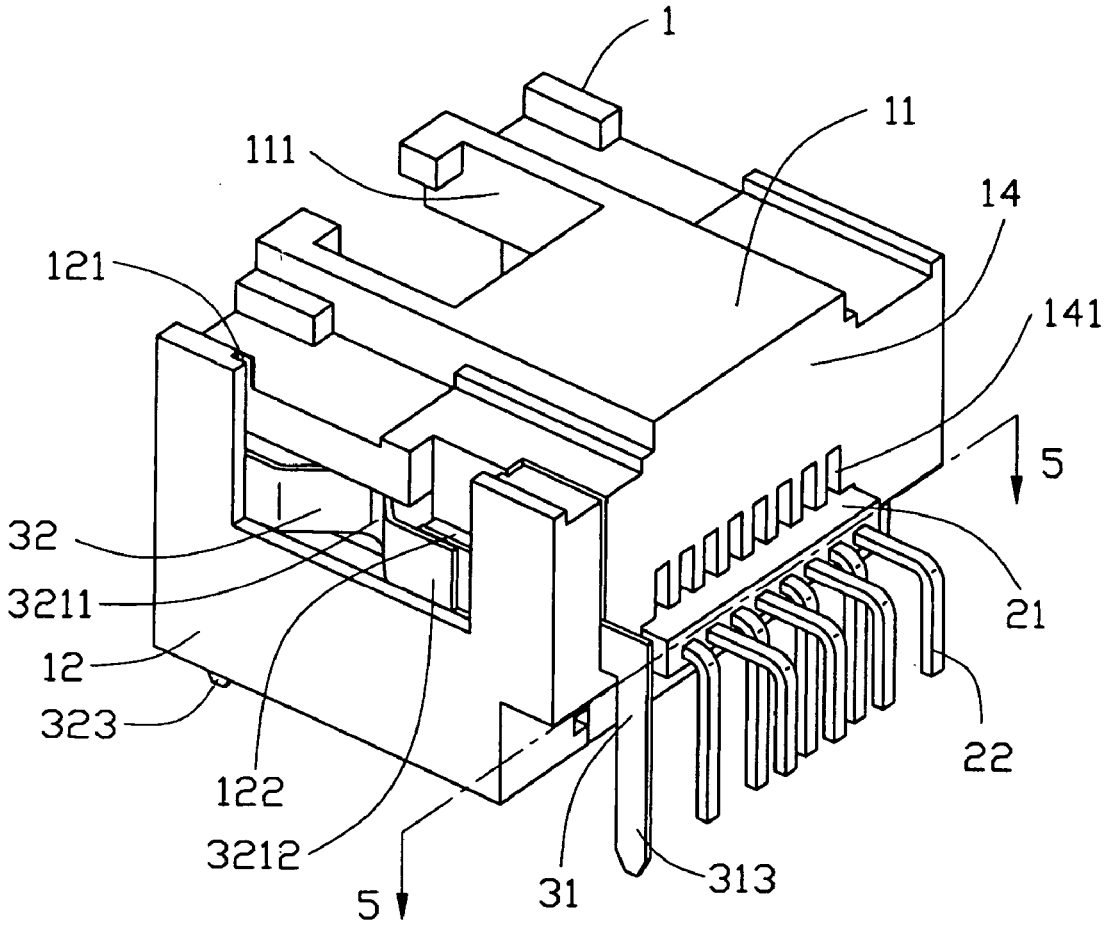
FIG. 2 is a similar view to FIG. 1, but taken from another perspective.
Figure 3:
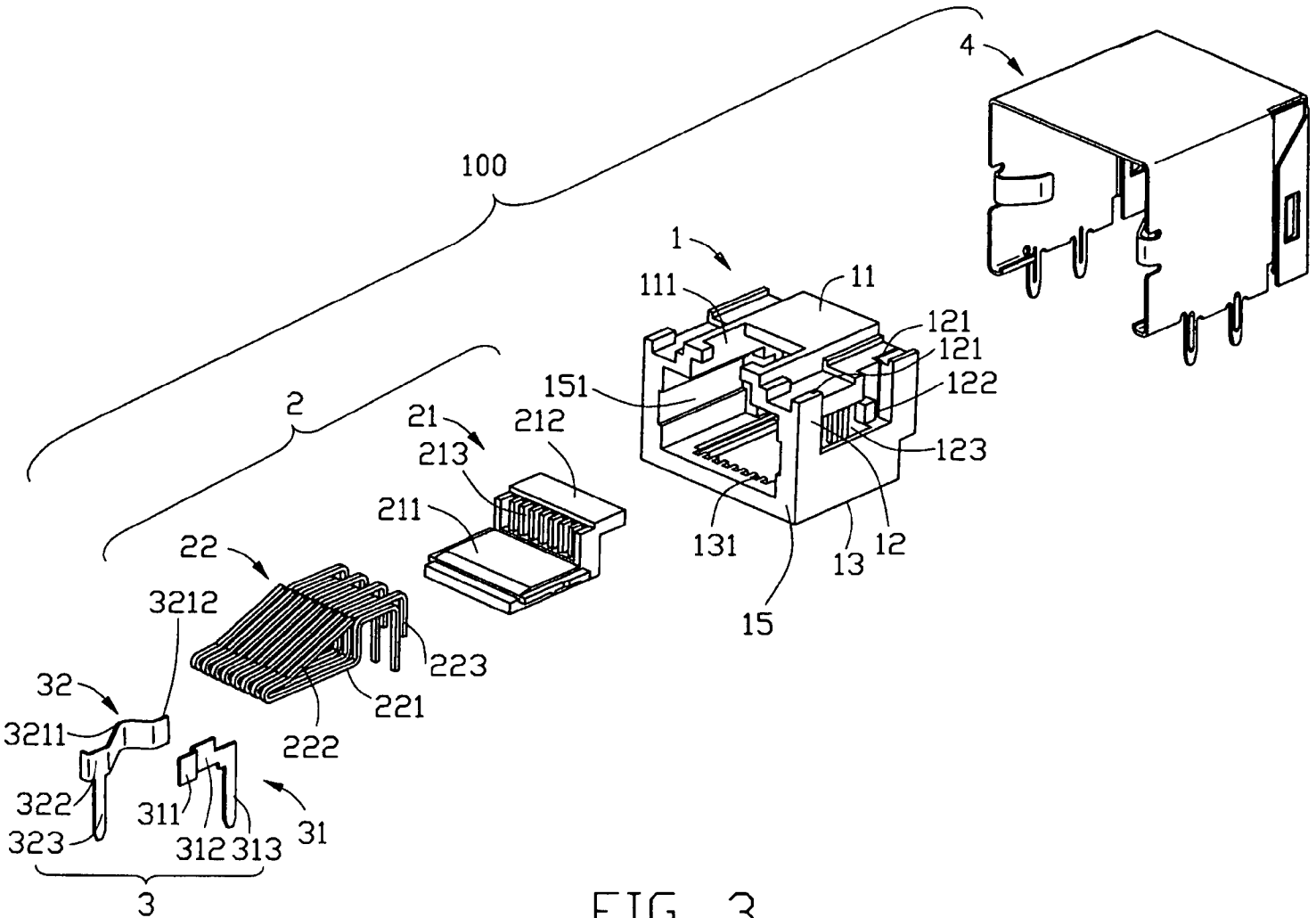
FIG. 3 is an exploded view of the electrical connector.

As shown in FIGS. 1–3, a modular jack 100 according to the present invention includes an insulative housing 1, a contact module 2, a detective switch 3 for detecting the insertion of a complementary connector (not shown) and an outer metal shield 4 enclosing the insulative housing 1. The contact module 2 includes an insulative block 21 and a plurality of contacts 22 fixed in the block 21. The detective switch 3 includes an immovable switch 31 and a movable switch 32 cooperating with the immovable switch 31.

Figure 4:
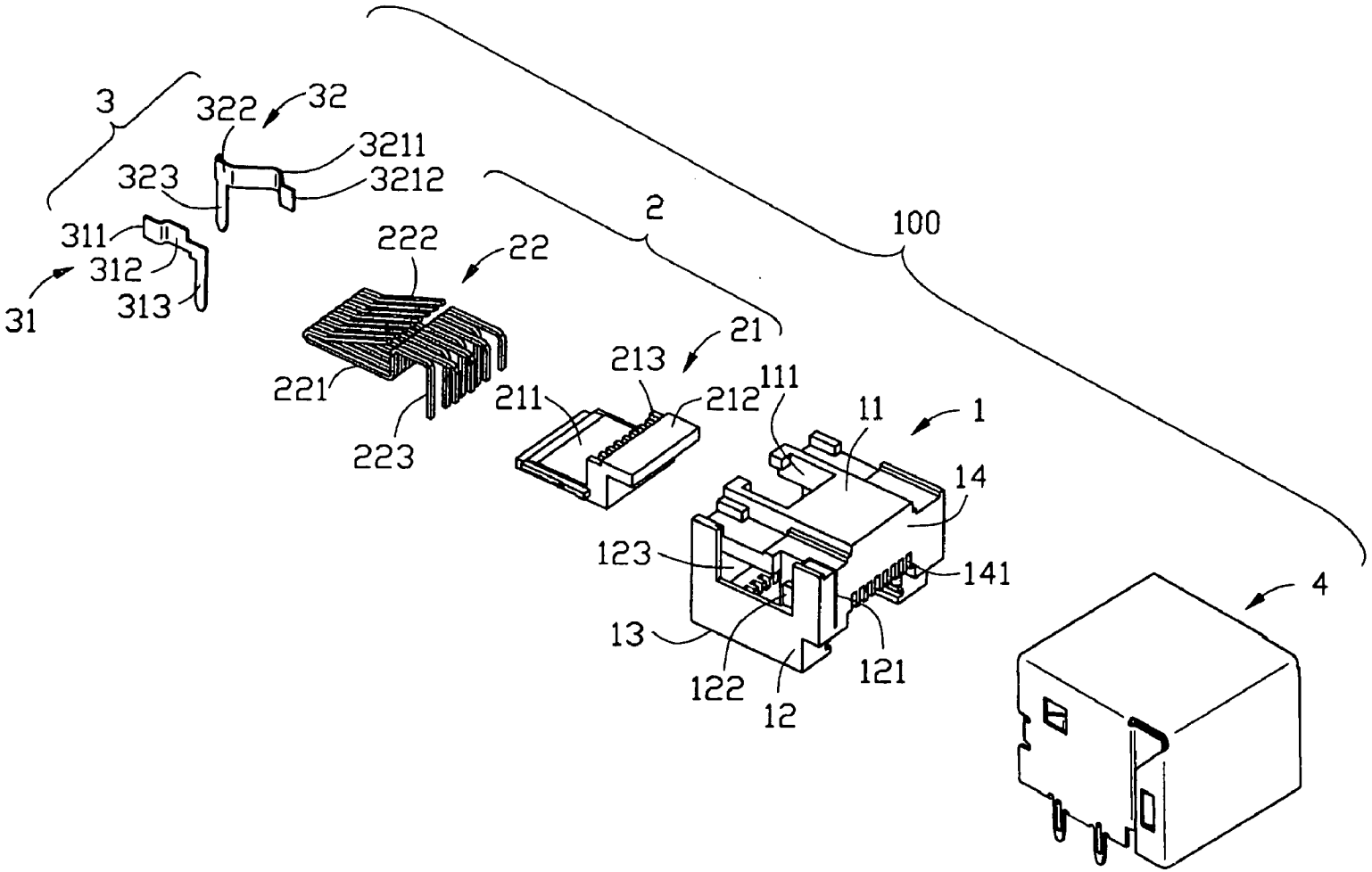
FIG. 4 is a similar view to FIG. 3, but taken from another perspective.
Figure 5:
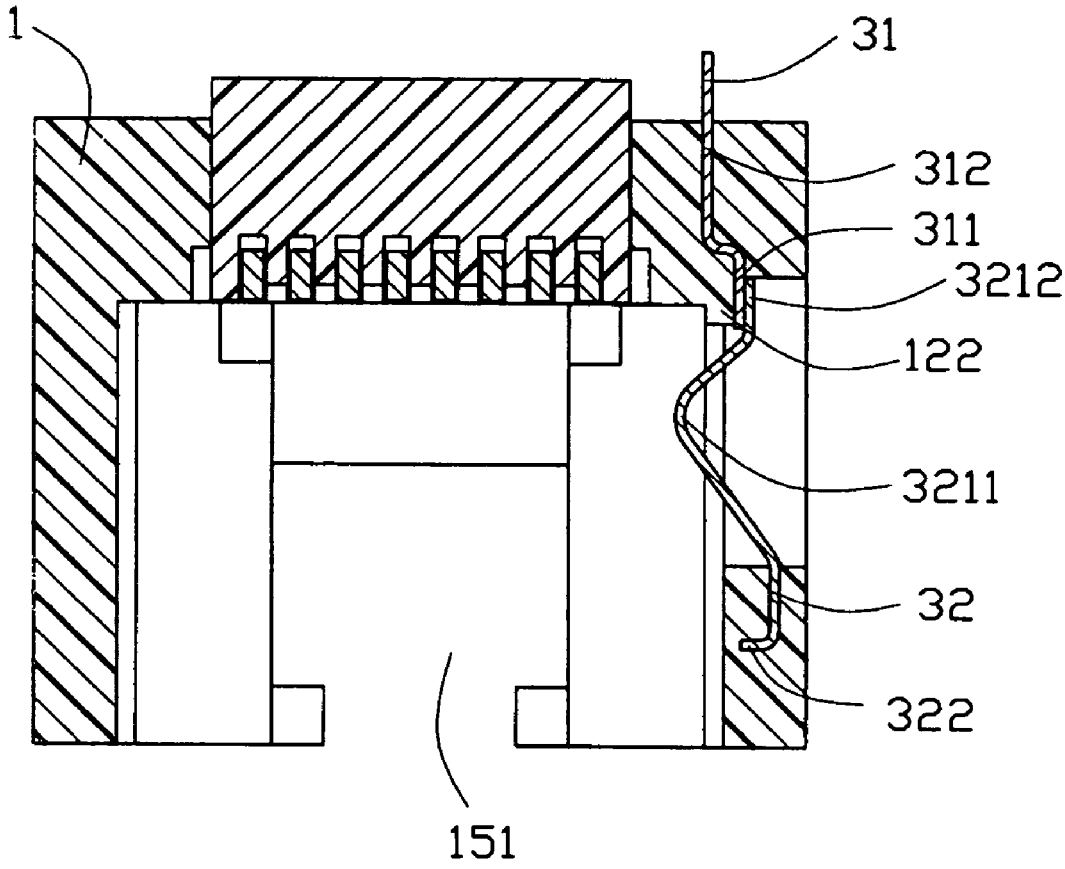
FIG. 5 is a cross sectional view of the modular jack taken along 5—5 line of FIG. 2, with the immovable switch engaging with the movable switch.
Figure 6:
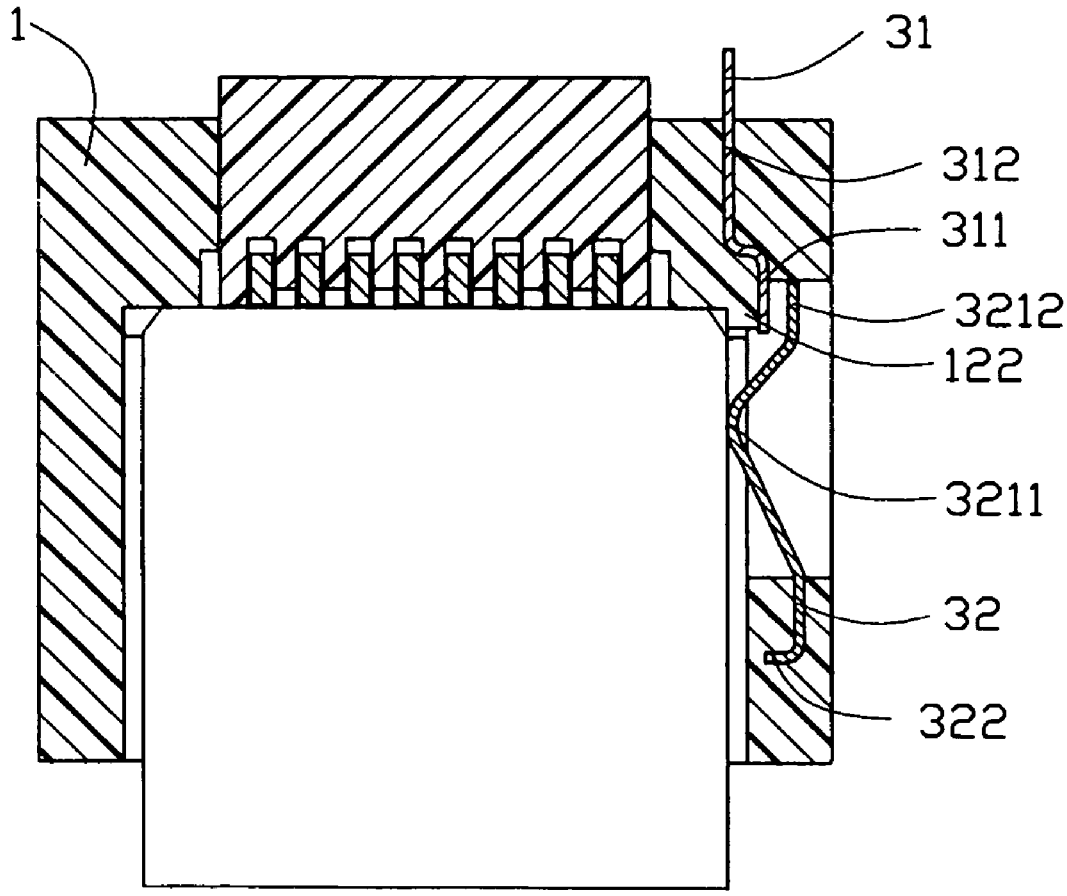
FIG. 6 is another cross sectional view of the modular jack with a complementary connector being inserted into the receiving cavity.
Figure 7:
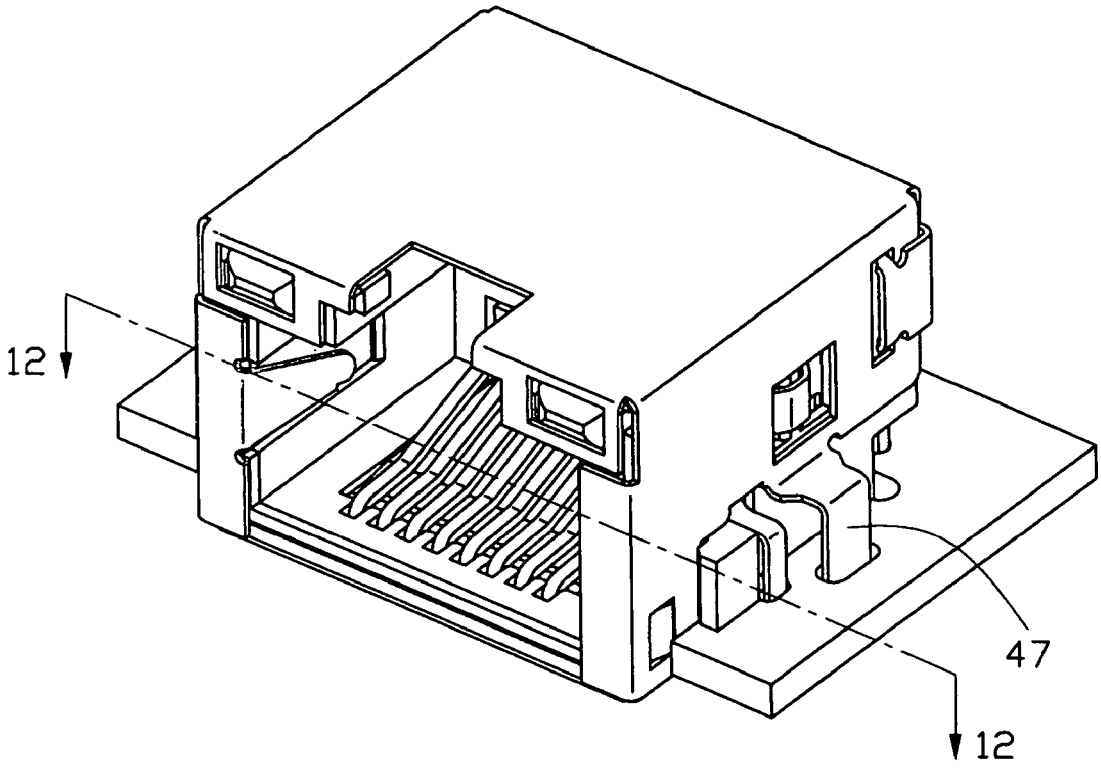
FIG. 7 is another embodiment of a modular jack mounted on the printed circuit board.

Referring to FIGS. 3–4, the insulative housing 1 includes a top wall 11, a pair of sidewalls 12, a bottom wall 13 and a rear wall 14. The housing 1 further includes a front mating face 15 defining a receiving cavity 151 backwardly extending from the mating face 15. The top wall 11 defines an opening 111 for engaging with the complementary connector. One sidewall 12 defines a longitudinal slot 121 for receiving the detective switch 3, a protrusion 122 for resisting the detective switch 3 and a cutout 123 communicating with the receiving cavity 151. The bottom wall 13 defines a plurality of recesses 131 for receiving the contacts 22. The rear wall 14 defines a plurality of vertical grooves 141.

The contact module 2 includes an insulative block 21 and a plurality of contacts 22 fixed in the block 21. The block 21 includes a planar base portion 211 and a bent portion 212 upwardly bending and extending from an end of the base portion 211. A plurality of passageways 213 are defined in the bent portion 212. Each contact 22 comprises a horizontal portion 221 through the corresponding passageway 213 of the bent portion 212, a contact portion 222 slant upwardly extending from an end of the middle portion 221 and a soldering portion 223 for electrically connecting with a printed circuit board (not shown).

The detective switch 3 includes an immovable switch 31 and a moveable contact 32 respectively fixed in the slot 121 of the sidewall 12 of the insulative housing 1. The immovable switch 31 includes a first engaging portion 311, a first latch portion 312 for latching with the slot 121 of the insulative housing 1 and a first soldering portion 313 for electrically connecting with the printed circuit board. The movable switch 32 includes a projecting portion 3211 interiorly bending and extending into the receiving cavity 151 of the insulative housing 1, a second engaging portion 3212 abutting against the first engaging portion 311 of the immovable switch 31, a second latch portion 322 for latching with the slot 121 of the sidewalls of the insulative housing 1. A second soldering portion 323 downwardly extending from the latch portion 322 for electrically connecting with the printed circuit board.

Referring to FIGS. 1–6, in assembly, firstly, the contact module 2 is inserted into the insulative housing 1 from a rear portion of the housing 1. The horizontal portions 222 of the contacts 22 are inserted into the corresponding recesses 131 and the contact portions 222 of the contacts 22 are received in the receiving cavity 15. The free ends of the contact portions 222 extend into the passageways 141 of the rear wall 14. The soldering portions 223 of the contacts 22 extend beyond the rear wall 14. Secondly, The detective switch 3 is assembled in the sidewalls 12 of the insulative housing 1. The first latching portion 312 of the immovable switch 31 and the second latching portion 322 of the movable switch 32 are received in the slot 121 of the sidewalls 12 of the insulative housing 1. The first soldering portion 313 and the second soldering portion 323 of the immovable switch 31 extend beyond the bottom wall 13 of the insulative housing 1 to electrically connect with the printed circuit board. The first engaging portion 311 of the immovable switch 31 abuts against the protrusion 122 of the sidewalls 12. The projecting portion 3211 of the movable switch 31 projects into the receiving cavity 151 of the housing 1 through the cutout 123. The second engaging portion 3212 of the movable switch 32 abuts against the first engaging portion 311 of the immovable switch 31. Then, the outer shield 4 is assembled on the insulative housing 1. Finally, the soldering portions 223 of the conductive contacts 22, the first soldering portions 313 of the detective switch 3 and outer shield 4 are soldered to corresponding dots of the printed circuit board.

Refer to FIGS. 7–13, it discloses a second embodiment of the present invention, which is substantially identical to the first embodiment except the structure of the detective switch 3. Furthermore, in the second embodiment, it discloses an electrical connector assembly 100 which includes a modular jack 10 and a printed circuit board 5. The electrical connector is formed in countersink type, in other words, the printed circuit board 5 defines a cutout (not labeled) corresponding to the insulative housing 1. Thus, the printed circuit board 5 is able to be mounted on a substantially middle portion of the insulative housing 1, thereby decreasing the total height of the electrical connector assembly 100.

Figure 8:
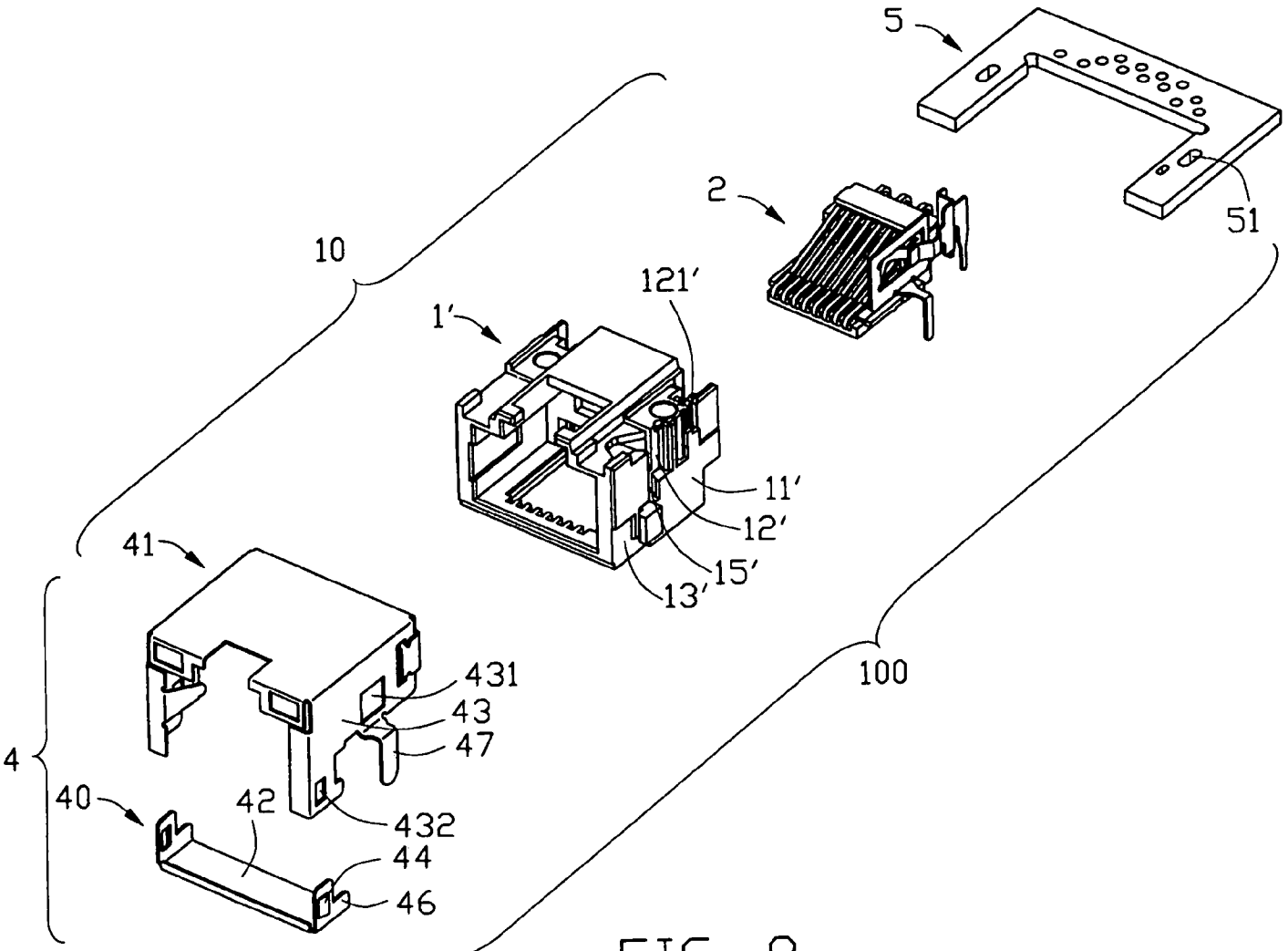
FIG. 8 is an exploded view of the modular jack of FIG. 7.
Figure 9:
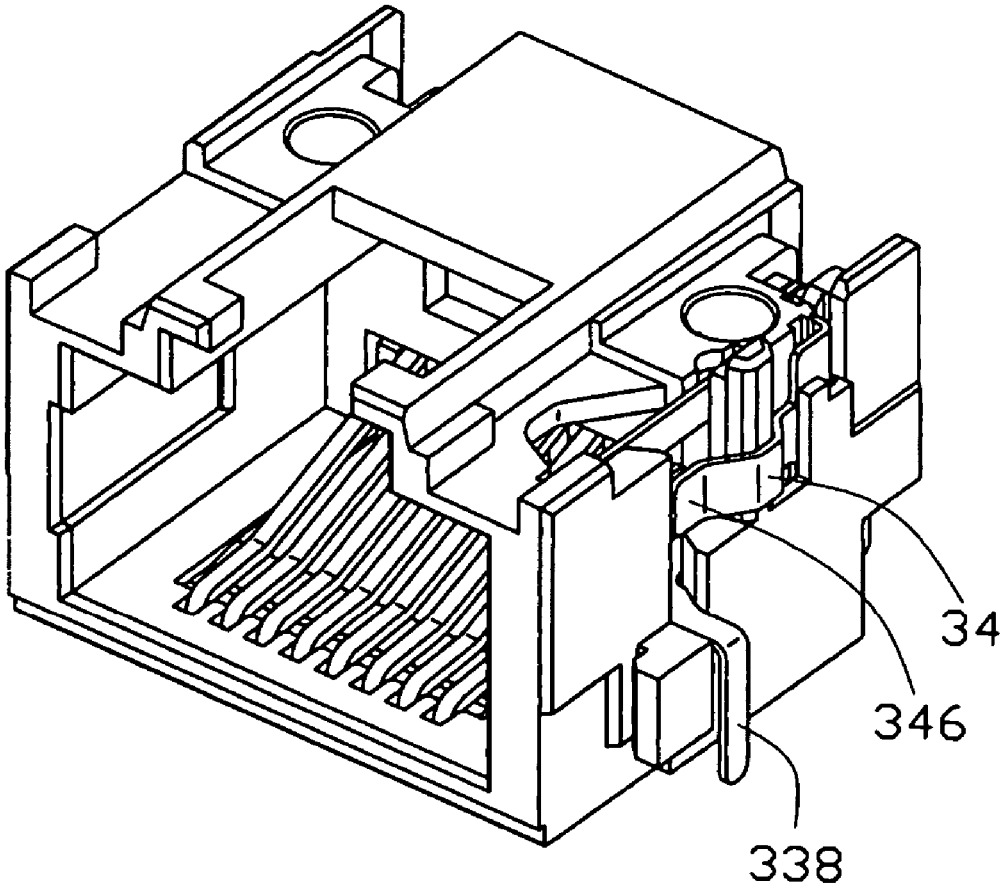
FIG. 9 is a partially assembled view of the modular jack of FIG. 7.
Figure 10:
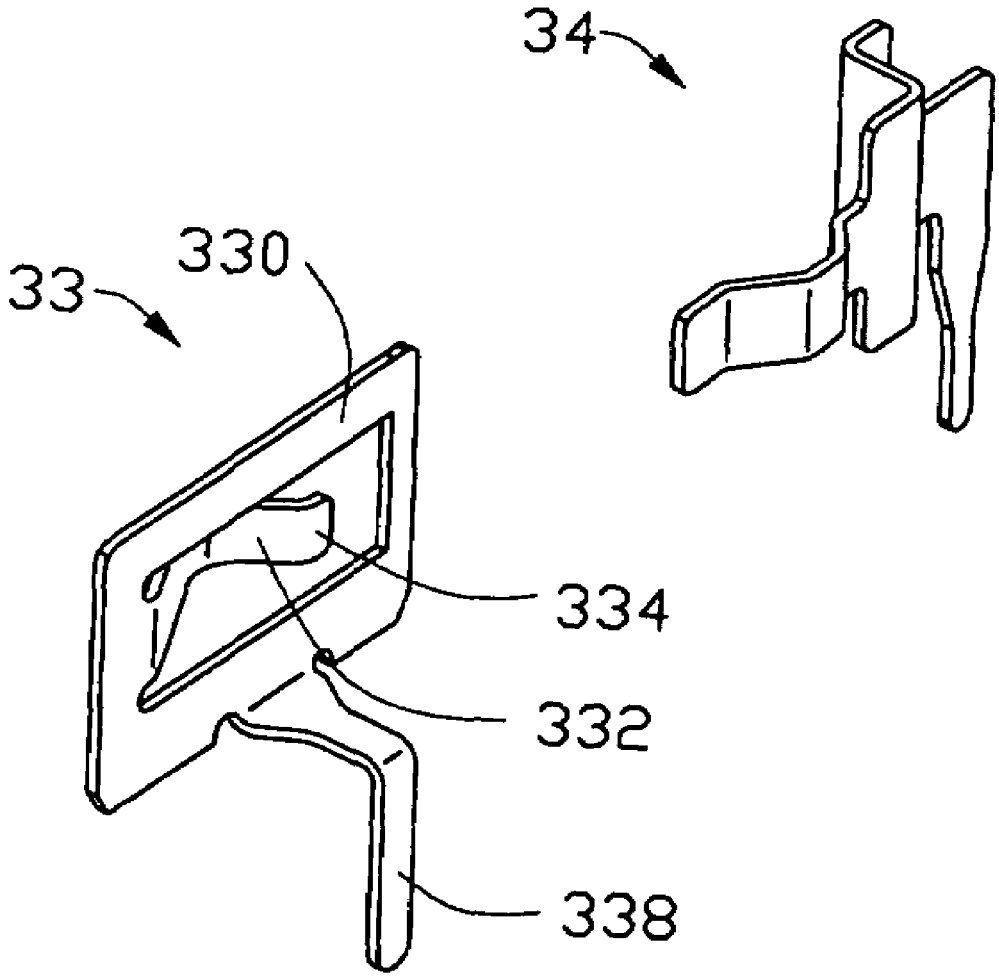
FIG. 10 is a perspective view of the detective switch of the modular jack of FIG. 7.
Figure 11:
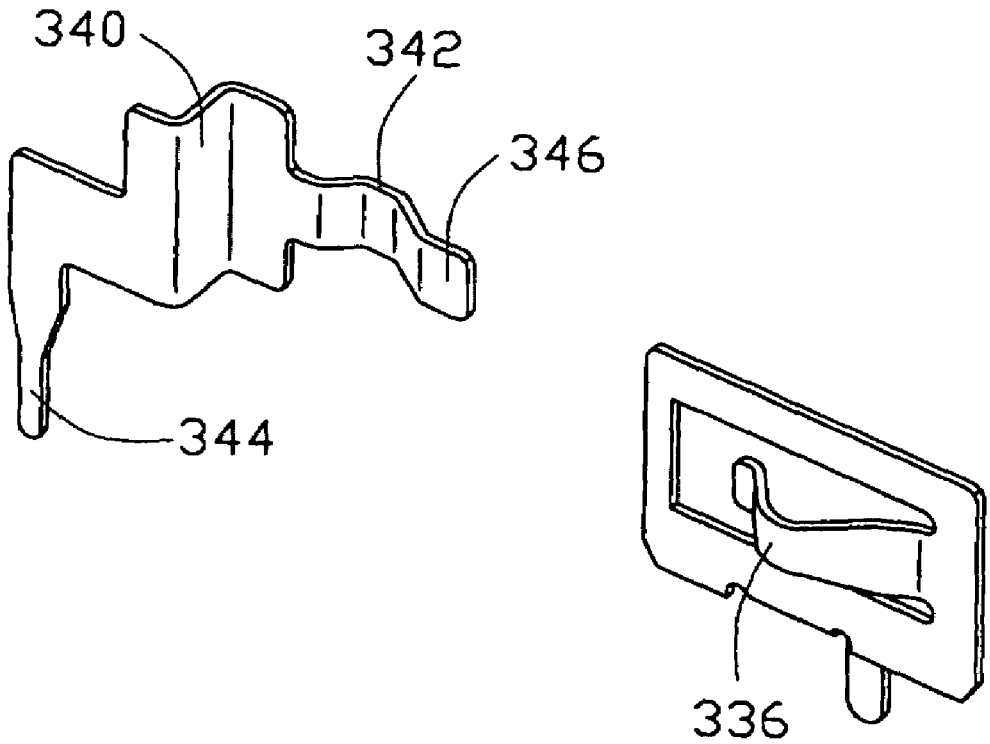
FIG. 11 is another perspective view of the detective switch of the modular jack of FIG. 7.
Figure 12:
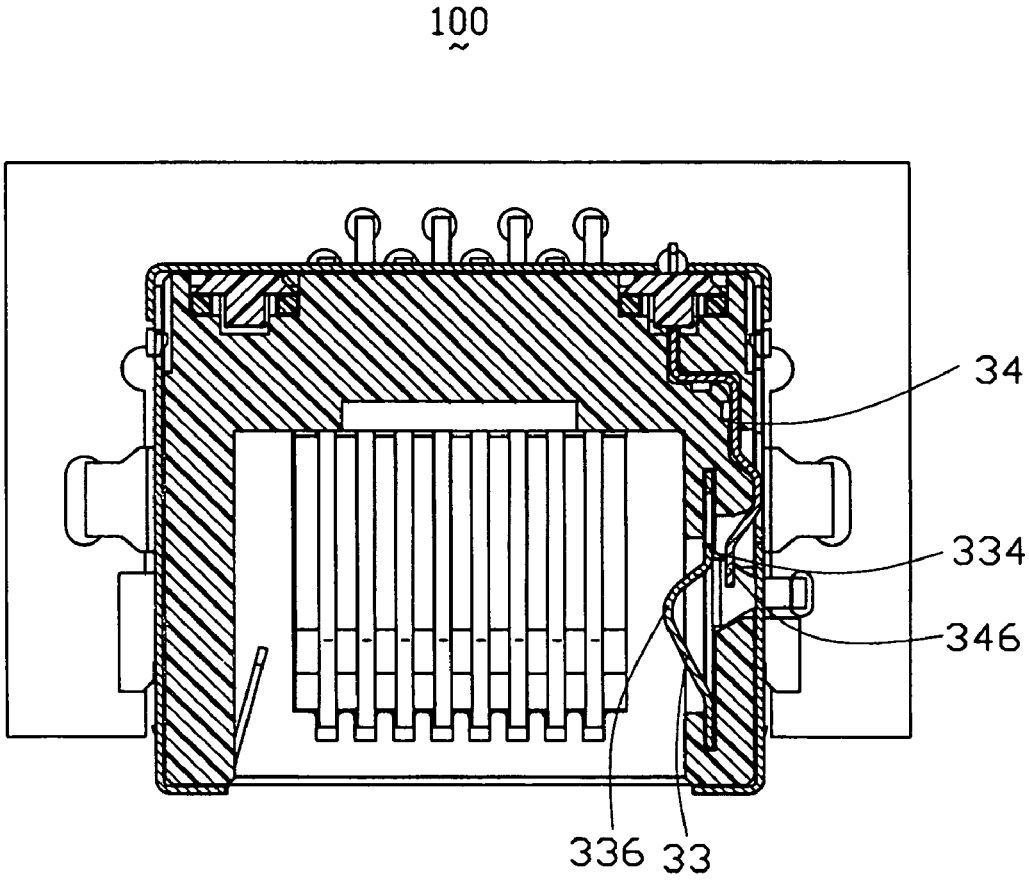
FIG. 12 is a cross-sectional view of the modular jack of FIG. 7 when no plug is inserted into the cavity.
Figure 13:
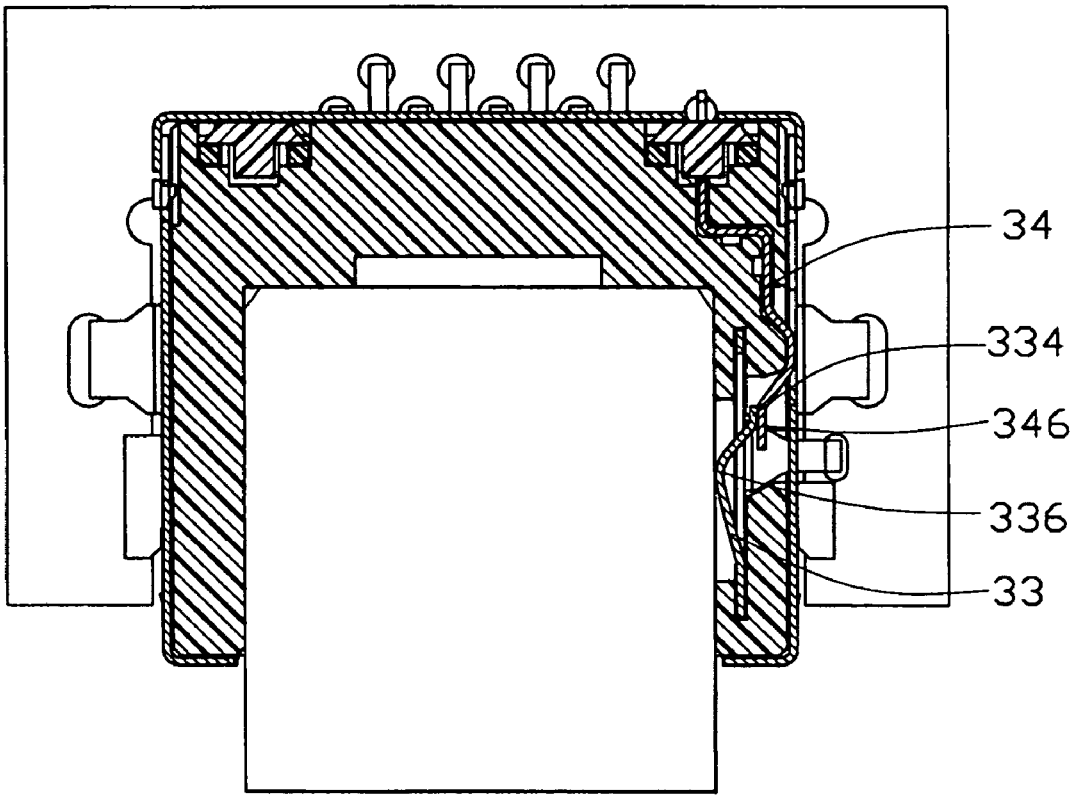
FIG. 13 is a cross-sectional view of the modular jack of FIG. 7 when the plug is inserted into the cavity.

In the second embodiment, refer to FIGS. 8–9, the detective switch 3 includes a moveable contact 33 and an immoveable contact 34. The moveable contact 33 includes a substantially rectangle frame 330 and a solder tail 338 bent and downwardly extending from the frame 330. A spring beam 332 laterally extends from an inter face of the rectangle frame 330. The spring contact 332 includes a first bent engaging portion 336 formed in a substantially middle portion thereof and a second engaging portion 334 formed in a free end thereof. The immovable contact 34 includes a Z-shaped body portion 340, a solder tail 344 downwardly extending from the body portion 340 and a cantilevered spring beam 342 laterally extending from the body portion 340. The cantilevered spring beam 342 defines an mating portion 346 for engaging with the second engaging portion 334 of the movable contact 33.

The electrical connector assembly 100 further a detached metal shell 4, which is different from the metal shell 4 of the first embodiment in structure. The detached metal shell 4 includes an upper shell 41 and a lower shell 40 locked with each other. The lower shell 40 includes a base portion 42 and a pair of arms 44 upwardly extending from the base portion 42. The pair of arms 44 respectively forms a protrusion 46. The upper shell 41 includes a pair of sidewalls 43, one of which defines an opening 431 in a generally middle portion thereof. A solder tail 47 is bent and downwardly extends from a bottom edge of one of the sidewalls 43. A pair of recesses 432 are respectively formed in a bottom portion of the pair of sidewalls 43.

The insulative housing 1 includes a pair of opposite sidewalls 11', one of which defines a cutout 12' for exposing the detective contact 3 in a middle portion of the sidewall 11'. The sidewall 11' defines a pair of longitudinal slots 121' for receiving the movable contact 33 and the immovable contact 34. The pair of longitudinal slots 121' are respectively formed in opposite sides of the cutout 12' and communicate with the cutout 12'. The sidewall 11' further defines a groove 15' adjacent to the cutout 12' for exposing the solder tail 338 of the movable contact 33 and communicate with the cutout 12'. A pair of recesses 13' are formed in a bottom portion of the pair of sidewalls 11' for receiving the arms 44 of the lower shell 41.

In assembly, firstly the rectangular frame 330 of the movable contact 33 and the Z-shaped body portion 340 of the immovable contact 34 are respectively received in the longitudinal slots 121' of the insulative housing 1. It is to be noted that the second engaging portion 334 of the movable contact 33 does not contact with the mating portion 346 of the immovable contact 34 in original shape. In addition, the solder tail 344 extends beyond a bottom portion of the insulative housing 1 via the longitudinal slot 121'. Secondly, the upper shell 41 and the lower shell 40 are mounted on the insulative housing 1 and locked with each other via the protrusions 44 of the lower shell 40 engaging with the recesses 432 of the upper shell 41. It is to be noted that the solder tail 338 exposes to air via the groove 15'. In the second embodiment, the solder tail 338 of the movable contact 33 and the solder tail 334 of the immovable contact 34

When the complementary connector has not inserted in the modular jack 100, a detecting system of the computer is in idle state and no power is transferred to the modular jack for saving power to the computer. In use, firstly, the complementary connector is inserted into the receiving cavity 151 of the insulative housing 1. The complementary connector resists the projecting portion 3211 and deflects the projecting portion 3211 transversely and outwardly to disconnect with the first engaging portion 3212 of the immovable switch 31. As a result, the detective function is realized. The detecting system is changed to working state and the power beams to be transferred to the modular lack 100 this time. In the conventional connector, the detecting system is in working state all the time and the power is transferred to the modular jack 100 all the time for detecting if the complementary plug connector is inserted in. Compare with the conventional connector, in the present invention, the power is transferred to the modular jack only when the detective function is realized and this can save power for the computer.

It is noted that the detective switch 3 can be disposed in the bottom or rear wall of the insulative housing 1. In addition, the conductive contacts 22 and the detective switch 3 also can be insert-molded with the insulative housing 1.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A modular jack assembly comprising:

an insulative housing defining a receiving cavity;

a metallic shield covering said housing;

a plurality of conductive contacts disposed in the cavity of housing; and a detective switch disposed in the housing and including a rear switch having a board-mounting tail located around a rear face of the housing and a front switch having a board-mounting tail located around a front face of the housing, said rear switch and said front switch respectively having engaging portions for engagement with or disengagement from each other, the front switch having a projecting portion being deflected by a plug which is inserted into the cavity;

wherein said housing define a side wall around which said detective switch is located;

wherein said side wall defines an opening laterally extending therethrough for accommodating deflection of said detective switch;

wherein said metallic shield includes side face having a through hole aligned with said opening to allow said deflection of the detective switch.

2. The assembly as claimed in claim 1, wherein the board-mounding tail of the front switch is located outside of said side wail.

3. A modular jack assembly comprising;

a print circuit board defining a notch in an edge area;

an insulative housing received in said notch and defining a receiving cavity therein;

a plurality of conductive contacts disposed in the housing;

a metallic shield covering said housing; and a detective switch disposed in the housing and including a rear switch having a board-mounting tail located around a rear face of the housing and a front switch having a board-mounting tail located round a front face of the housing, said rear switch and said front switch respectively having engaging portions for engagement with or disengagement from each other, the front switch having a projecting portion being deflected by a plug which is inserted into the cavity;

wherein said housing defines a side wall around which said detective switch is located; therethrough for accommodating deflection of said detective switch;

wherein said metallic shield includes a side face having a through hole aligned with said opening to allow said deflection of the detective switch.

4. The assembly as claimed in claim 3, wherein the board-mounting tail of the front switch is located outside of said side wall.

* * * * *